US009805886B1

(12) United States Patent
Dhote et al.

(10) Patent No.: US 9,805,886 B1
(45) Date of Patent: Oct. 31, 2017

(54) ELECTRICAL SWITCH AND SLIDER ASSEMBLY THEREFOR

(71) Applicant: EATON CORPORATION, Cleveland, OH (US)

(72) Inventors: Navneet Ramkrushnaji Dhote, Pune (IN); Nilesh Kamlakar Sawai, Pune (IN); Pramod Kumar, Peachtree City, GA (US); Oscar L. Neundorfer, Senoia, GA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 15/145,201

(22) Filed: May 3, 2016

(51) Int. Cl.
*H01H 21/00* (2006.01)
*H01H 23/16* (2006.01)
*H01H 15/16* (2006.01)

(52) U.S. Cl.
CPC ..... *H01H 23/164* (2013.01); *H01H 15/16* (2013.01)

(58) Field of Classification Search
CPC ..... H01H 23/145; H01H 15/10; H01H 1/12; H01H 1/36; H01H 3/00; H01H 3/02; H01H 15/00; H01H 15/02; H01H 2221/00; H01H 2221/014; H01H 15/16; H01H 23/164
USPC ..... 200/547, 553, 431–437, 531, 502, 5 R, 200/5 EA, 537, 549, 550, 16 E, 178, 200/51 R, 51.02, 563, 252, 241
See application file for complete search history.

(56) References Cited

U.S. PATENT DOCUMENTS

| | | | | |
|---|---|---|---|---|
| 4,190,754 A * | 2/1980 | Kilar | H01H 15/10 200/17 R |
| 6,861,605 B2 * | 3/2005 | Wong | H01H 15/06 200/261 |
| 2012/0306376 A1 | 12/2012 | Altonen et al. | |
| 2013/0106287 A1 | 5/2013 | Savicki, Jr. et al. | |
| 2016/0189893 A1 * | 6/2016 | Dhote | H01H 23/145 200/547 |

* cited by examiner

*Primary Examiner* — Anthony R. Jimenez
(74) *Attorney, Agent, or Firm* — Eckert Seamans; Nathaniel Wilks; Grant Coffield

(57) ABSTRACT

A slider assembly is for an electrical switch having an upper housing. The slider assembly includes a slider mechanism structured to be disposed on an exterior surface of the upper housing and a shutter structured to be disposed in an interior of said upper housing and to be coupled to said slider mechanism. The shutter includes a number of biasing members structured to engage and apply a bias force against interior sidewalls of said upper housing, thereby creating a friction force associated with movement of said slider mechanism.

14 Claims, 6 Drawing Sheets

ELECTRICAL SWITCH AND SLIDER ASSEMBLY THEREFOR

BACKGROUND

Field

The disclosed concept relates generally to electrical switches and, more particularly, to electrical switches such as, for example, dimmer switches. The disclosed concept also relates to slider assemblies for dimmer switches.

Background Information

Electrical switches, such as dimmer switches, are commonly used to control the amount of power delivered to an electrical load, for example, in order to control the intensity of a lighting load, or to control the speed of a ceiling fan.

A dimmer switch is typically mounted to an electrical box disposed in a wall or other suitable structure, and is electrically connected between a power source and the electrical load. The dimmer switch generally include a faceplate coupled to the electrical box, and a user interface, such as a linear slider, which is movably disposed on the faceplate. The dimmer switch may also include a button or toggle for switching the load ON and OFF. The user interface cooperates with a potentiometer. That is, the linear slider is adjustable (i.e., movable) to correspondingly adjust (i.e., control) the current delivered to the load and thus the intensity of the light or the speed of the fan. To ensure effective operation and user satisfaction, the linear slider must have desirable operating characteristics and ergonomics.

There is room for improvement in electrical switches, such as dimmer switches, and in slider assemblies therefor.

SUMMARY

These needs and others are met by embodiments of the disclosed concept, which are directed to a slider assembly for electrical switches, which among other benefits, exhibits improved operating characteristics and ergonomics.

As one aspect of the disclosed concept, a slider assembly is provided for an electrical switch having an upper housing. The slider assembly comprises: a slider mechanism structured to be disposed on an exterior surface of the upper housing; and a shutter structured to be disposed in an interior of said upper housing and to be coupled to said slider mechanism, said shutter including a number of biasing members structured to engage and apply a bias force against interior sidewalls of said upper housing, thereby creating a friction force associated with movement of said slider mechanism.

As another aspect of the disclosed concept, an electrical switch comprises: an upper housing having an exterior surface and an interior including a number of interior sidewalls; a slider mechanism disposed on the exterior surface of the upper housing; and a shutter disposed in the interior of said upper housing and coupled to said slider mechanism, said shutter including a number of biasing members structured to engage and apply a bias force against the interior sidewalls of said upper housing, thereby creating a friction force associated with movement of said slider mechanism.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
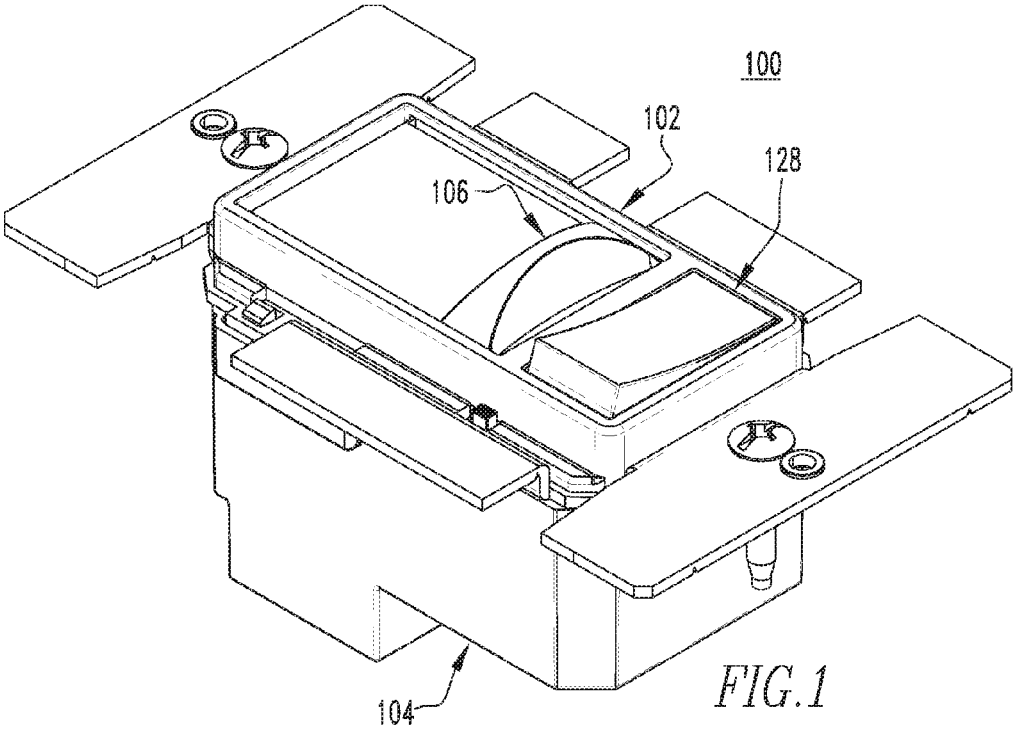
FIG. 1 is an isometric view of an electrical switch in accordance with an example embodiment of the disclosed concept.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, left, right, top, bottom and derivatives thereof, relate to the orientation of the elements shown in the drawings and are not limiting upon the claims unless expressly recited therein.

As employed herein, the term "number" shall mean one or an integer greater than one (i.e., a plurality).

As employed herein, the term "fastener" refers to any suitable connecting or tightening mechanism expressly including, but not limited to, rivets, screws, bolts and the combinations of bolts and nuts (e.g., without limitation, lock nuts) and bolts, washers and nuts.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the statement that a part is a "unitary piece" shall mean that the part is formed as a single piece of material without any fasteners, connections or other mechanisms attaching different pieces of the part together. For example and without limitation, a single molded plastic piece would be considered a unitary piece whereas two molded plastic pieces that are glued or otherwise attached to each other would not be considered a unitary piece.

As employed herein, the term "bias force" shall mean the force applied by one member against another due to elastic properties of at least one of the members. For example and without limitation, a spring, such as a leaf spring, that is compressed or distorted against a surface applies a bias force to the surface as the elastic properties of the spring attempt to return it to its relaxed state.

Figure 2:
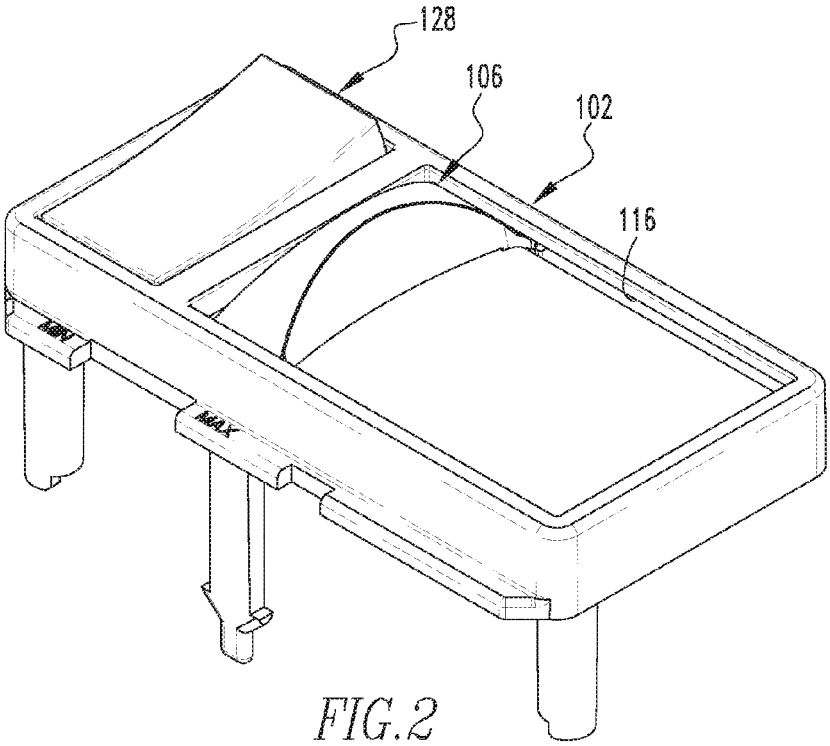
FIG. 2 is an isometric view of the electrical switch of FIG. 1 with a lower housing removed.
Figure 3:
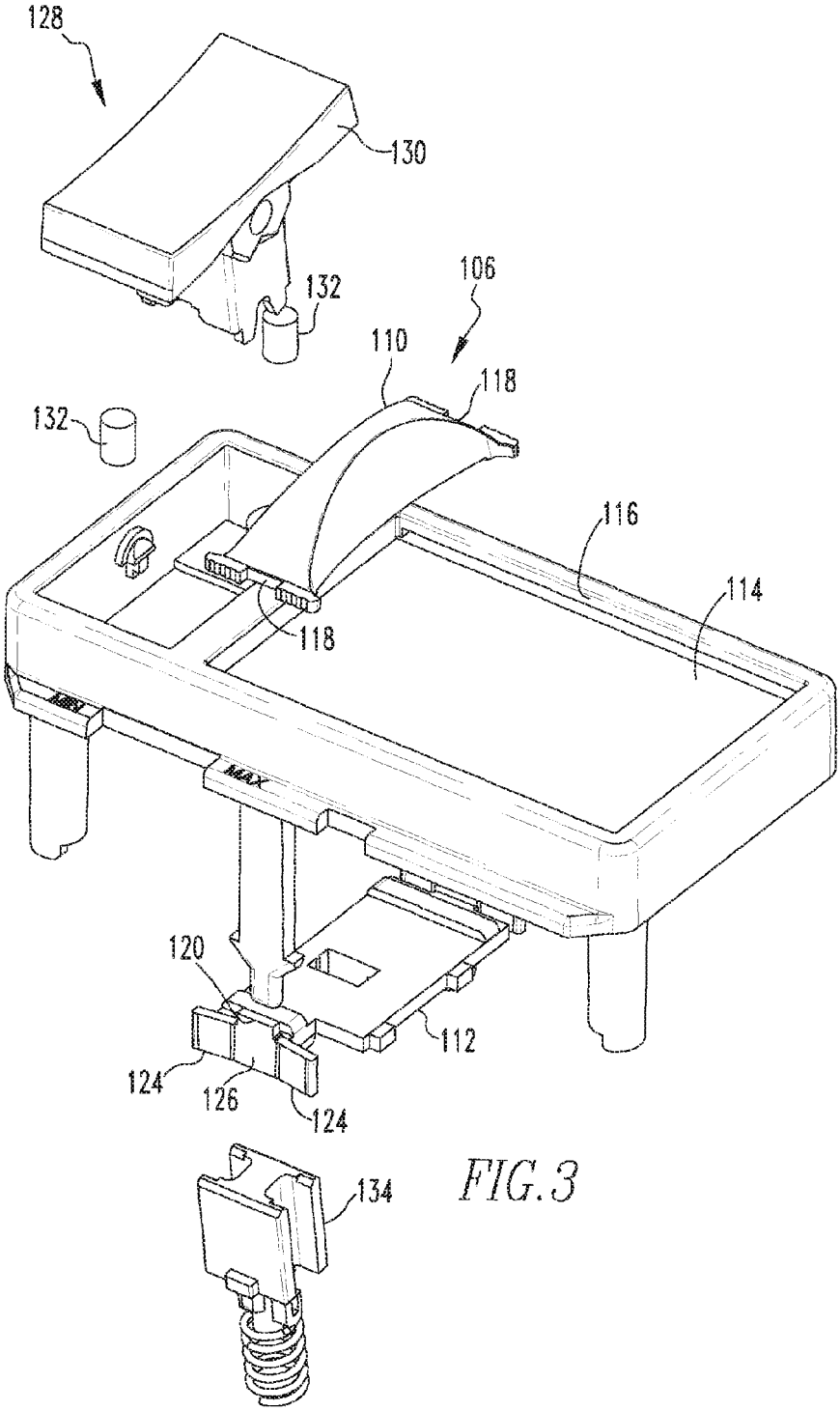
FIG. 3 is an exploded view of the electrical switch of FIG. 1 with the lower housing removed.
Figure 4:
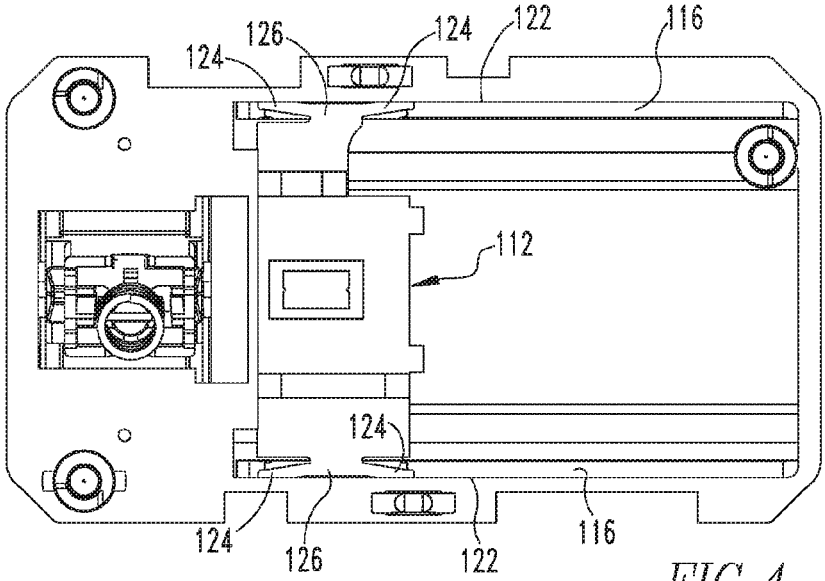
FIG. 4 is a bottom plan view of the electrical switch of FIG. 1 with the lower housing removed.

FIG. 1 is an isometric view of an electrical switch 100 (e.g., without limitation, a dimmer switch) in accordance with an exemplary embodiment of the disclosed concept. FIG. 2 is an isometric view of the electrical switch 100 of FIG. 1 with a lower housing 104 removed and FIG. 3 is an exploded isometric view of the electrical switch 100 of FIG. 1 with the lower housing 104 removed. FIG. 4 is a bottom plan view of the electric switch 100 with the lower housing 104 removed.

The electrical switch 100 includes an upper housing 102 and the aforementioned lower housing 104. The electrical switch 100 also includes a slider assembly 106 and a rocker switch assembly 128, which are shown in more detail in, for example, FIG. 3. The slider assembly 106 and the rocker switch 128 include at least some components that reside on an exterior of the upper housing 102 such that they may be interacted with by a user. The slider assembly 106 and the rocker switch 128 also include at least some components that reside inside the electric switch (i.e., the interior space enclosed by the upper and lower housings 102,104) and which interact with electrical components inside the electrical switch 100 to facilitate functions such as, without limitation, dimming and/or switching functions. As will be described in more detail herein, the slider mechanism 106 interacts with the upper housing 102 to provide a predetermined amount of friction when a user operates the slider assembly 106, thus providing a more desirable "feel" for the user.

As shown, for example, in FIG. 3, the slider assembly 106 includes a slider mechanism 110 and a shutter 112. The slider mechanism 110 is disposed on an exterior surface of the upper housing 102 and the shutter 112 is disposed in an interior of the upper housing 102. More specifically, the slider mechanism 110 is disposed on a slide surface 114 of the upper housing 102 and is structured to slide along a length of the slide surface 114. In some example embodiments of the disclosed concept, the slide surface 114 has a substantially rectangular shape and channels 116 are disposed along two opposite sides of the slide surface 114. The channels 116 are elongated openings that allow access between the exterior and the interior of the upper housing 102.

The slider mechanism 110 is engaged with the shutter 112 so that the shutter 112 slides in conjunction with the slider mechanism 110 (i.e., sliding the slide mechanism 110 causes shutter 112 to slide the same amount). In some example embodiments of the disclosed concept, notches 118 are formed at opposite ends of the slider mechanism 110. Protruding members 120 corresponding to the notches 118 are formed at opposite ends of the shutter 112. The protruding members 120 and notches 118 are illustrated in more detail in FIGS. 6A, 6B and 6C, which are, respectively, a bottom isometric view of the shutter 112, an upper isometric view of the shutter 112 and a bottom plan view of the shutter 112, and FIGS. 7A, 7B and 7C, which are, respectively, a bottom plan view of the slider mechanism 110, an upper isometric view of the slider mechanism 110 and a bottom isometric view of the slider mechanism 110. Referring to FIGS. 2-4, the slider mechanism 110 and the shutter 112 are structured such that the protruding members 120 may extend into the channel 116 and engage with the notches 118. When the slider mechanism 110 and the shutter 112 are engaged in this manner, sliding the slider mechanism 110 along the slide surface 114 will cause the shutter 112 to also slide the same amount inside the interior of the upper housing 102.

The shutter 112 may cooperate with an electrical element such as, for example and without limitation, a potentiometer (not shown) within the interior of the electrical switch 100 to provide a function such as, without limitation, a dimming function, when a user slides the slider mechanism 110. It will be appreciated that the disclosed slider assembly 106 may also be employed in combination with any electrical element (s) to provide any function where other types of sliders, slide switches or dimmer switches are employed.

Figure 5:
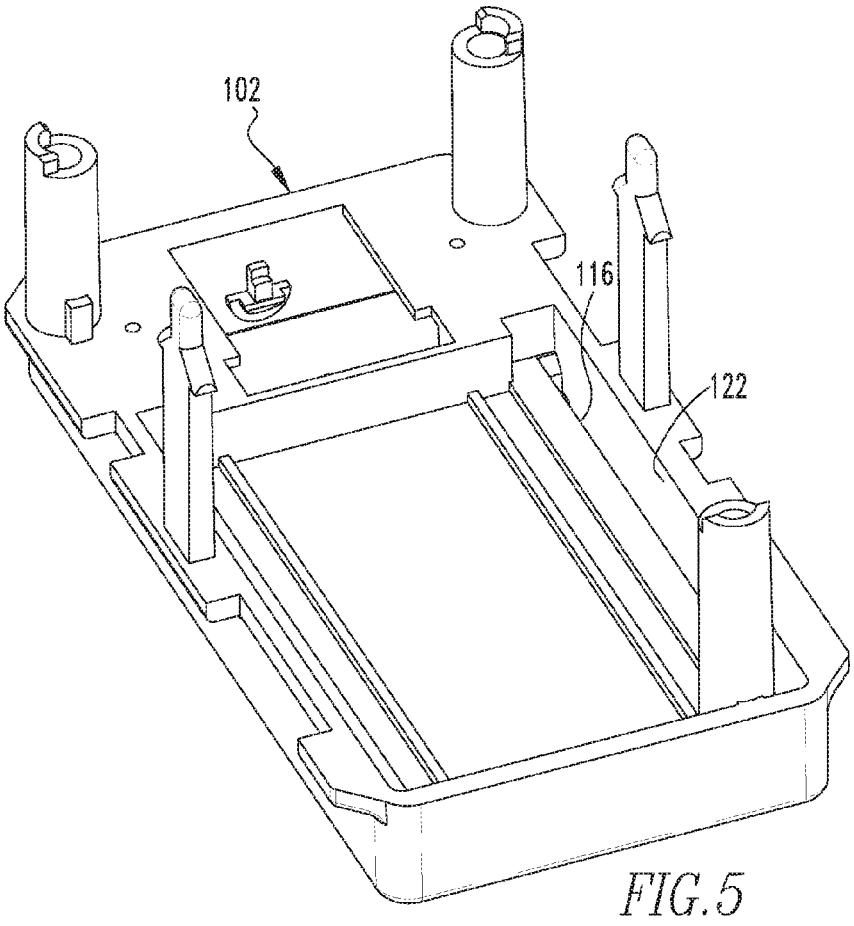
FIG. 5 is a bottom isometric view of a top housing of the electrical switch of FIG. 1.

The shutter 112 is structured to abut against interior sidewalls 122 of the upper housing 102. In some example embodiments of the disclosed concept, the sidewalls 122 extend in parallel with the channels 116, as is shown, for example, in FIG. 4. FIG. 5 is a bottom isometric view of the upper housing 102, which also shows an example of the sidewalls 122 extending in parallel with the channels 116. Referring back to FIG. 4, when the shutter 112 abuts against the interior sidewalls 122 of the upper housing 102, a friction force is created. Additionally, since the slider mechanism 110 is engaged with the shutter 112, the friction force will be felt by a user sliding the slider mechanism 110. The friction force provides a more desirable feeling for a user sliding the slider mechanism 110 compared with other types of sliders or slide switches that do not provide such friction force feedback.

Figure 6A:
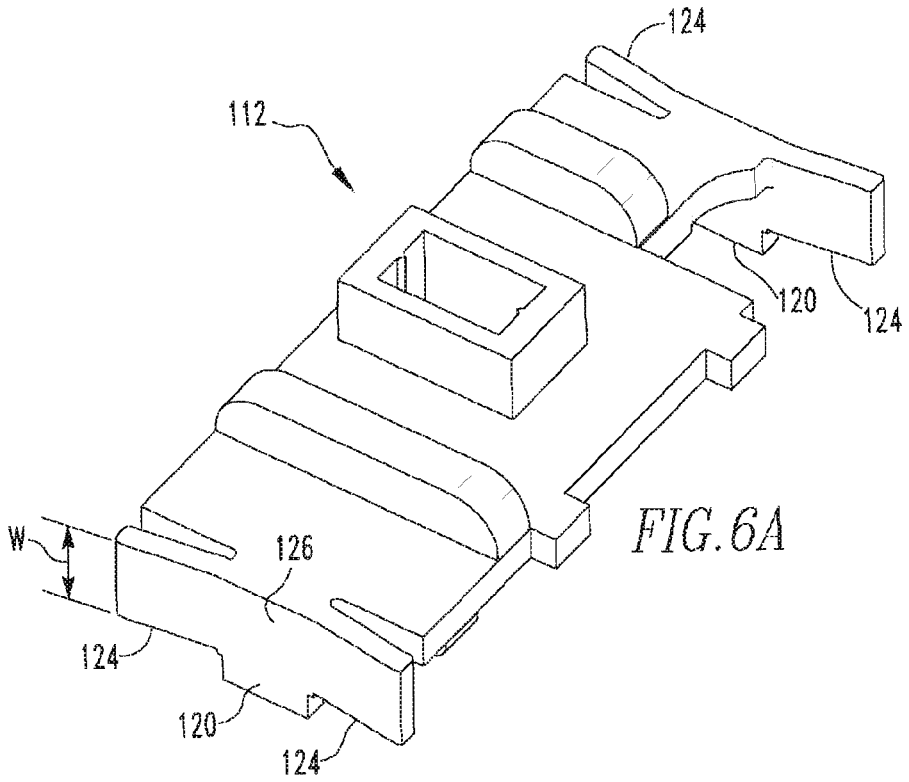
FIG. 6A is a bottom isometric view of a shutter in accordance with an example embodiment of the disclosed concept.
Figure 6B:
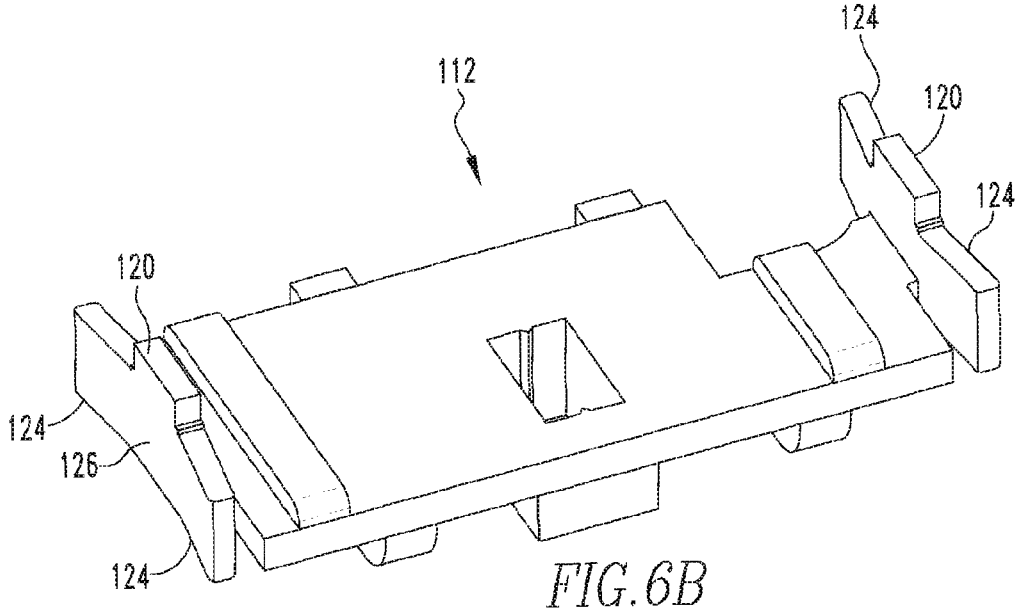
FIG. 6B is a top isometric view of the shutter of FIG. 6A.
Figure 6C:
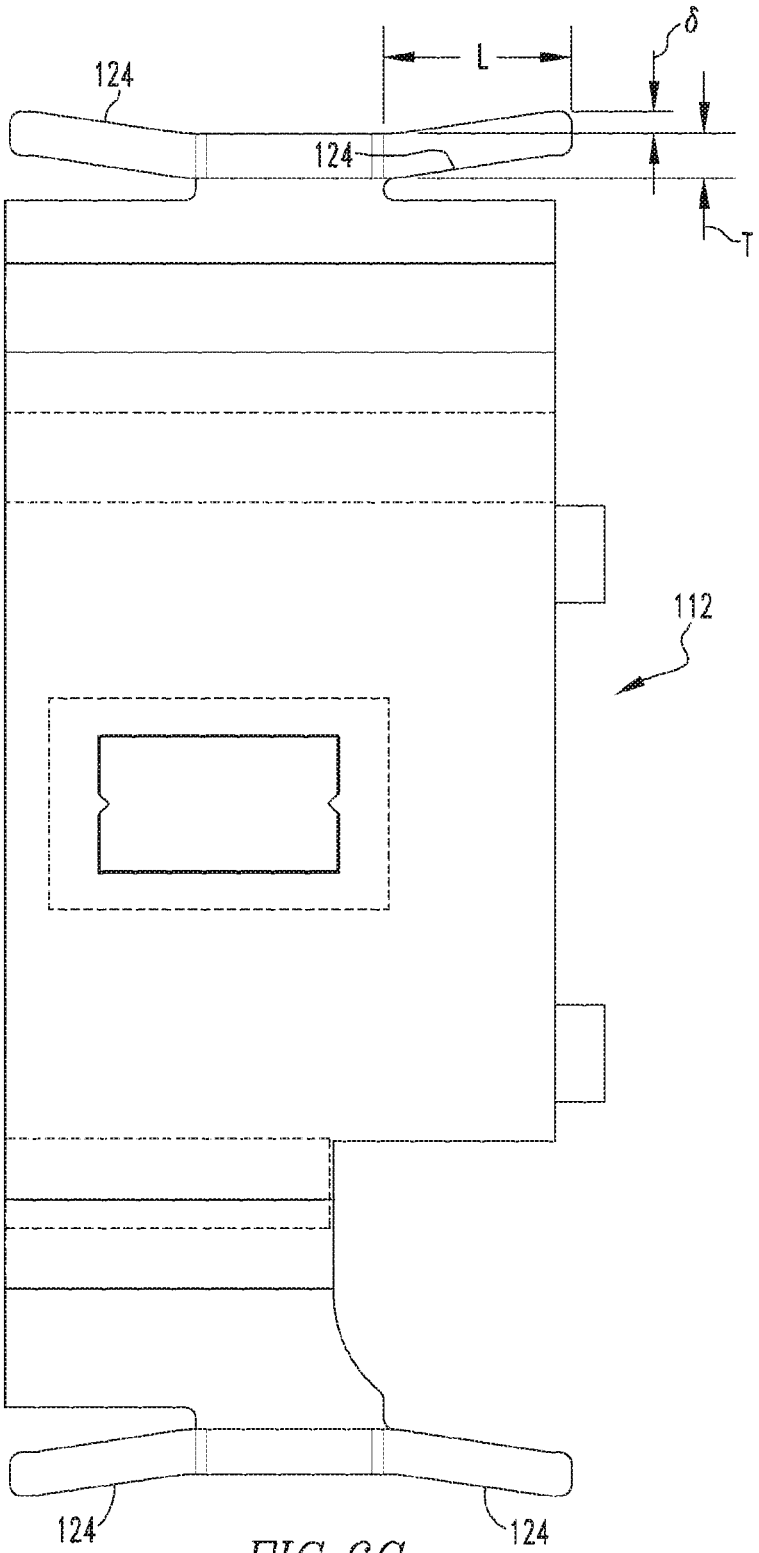
FIG. 6C is a top plan view of the shutter of FIG. 6A.
Figure 7A:
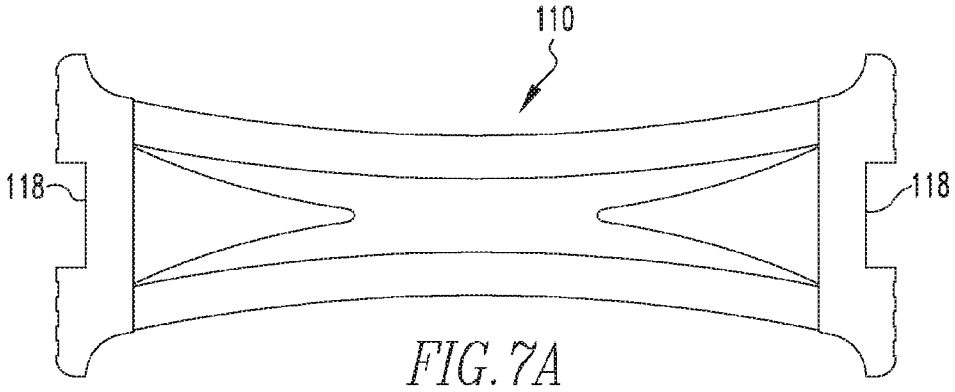
FIG. 7A is a bottom plan view of a slider mechanism in accordance with an example embodiment of the disclosed concept.
Figure 7B:
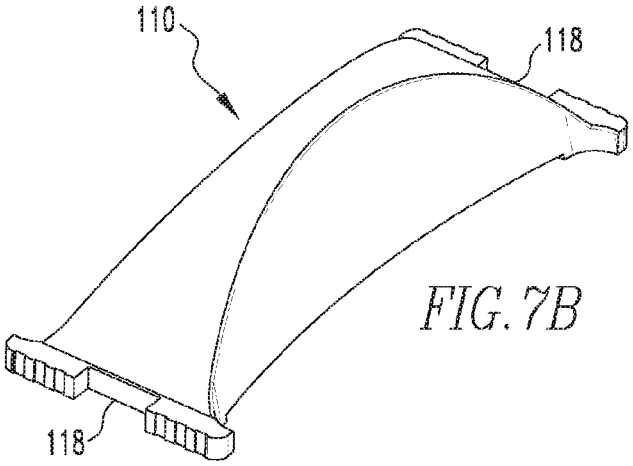
FIG. 7B is a top isometric view of the slider mechanism of FIG. 7A.
Figure 7C:
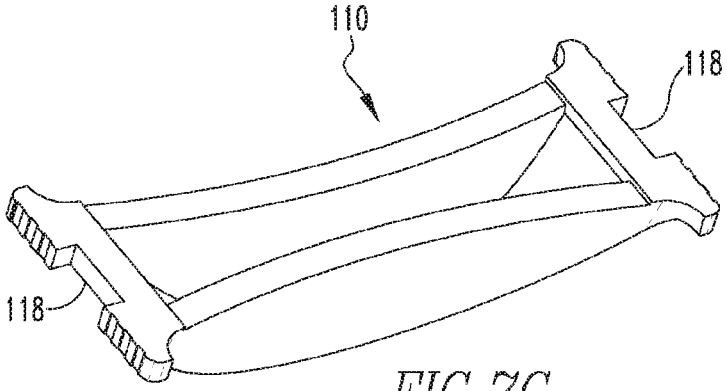
FIG. 7C is a bottom isometric view of the slider mechanism of FIG. 7A.

To facilitate a controlled and consistent friction force between the shutter 112 and the interior sidewalls 122, the shutter 112 includes biasing members 124. Referring to FIGS. 6A, 6B and 6C, the biasing members 124 are disposed at opposite ends of the shutter 112. The biasing members 124 are structured to apply a bias force against the interior sidewalls 122 when the shutter 112 is installed in the electric switch 100. In some example embodiments of the disclosed concept, the shutter 112 includes central end portions 126 that are disposed at opposite ends of the shutter 112. The biasing members 124 extend from edges of the central end portions 126 at an angle with respect to the central end portions 126, as is shown, for example, in FIG. 6C. When the shutter 112 is installed in the electric switch 100, as shown, for example, in FIG. 4, the biasing members 124 are depressed by the interior sidewalls 122 so that the angle between the central end portions 126 and the biasing members 124 is reduced. In some example embodiments of the disclosed concept, the amount of depression can cause the angle between the central end portion 126 and the biasing member 124 to be reduced so much that there is substantially no angle between the central end portion 126 and the biasing members 124 when the shutter 112 is installed in the electrical switch 100. The depression of the biasing members 124 by the interior sidewalls 122 causes the biasing members 124 to apply a bias force against the interior sidewalls 122, somewhat similar to a leaf spring.

Referring again to FIGS. 6A, 6B and 6C, in some example embodiments of the disclosed concept, each end portion of the shutter 112 (i.e., a central end portion 126 and the biasing members 124 extending from it) is a unitary piece such as, without limitation, a molded piece of plastic or another material. Also, in some example embodiments of the disclosed concept, the entire shutter 112 is a unitary piece such as, without limitation, a molded piece of plastic or another suitable material. However, the shutter 112 may also be constructed as separate pieces that are attached together using any suitable mechanism such as, without limitation, fasteners, adhesives, etc. For example and without limitation, each end portion of the shutter 112 may be a unitary piece and the central portion of the shutter 112 (i.e., the remainder of the shutter 112) may be a third unitary piece to which the end portions are attached.

The friction force created by the biasing members 124 may be predicted based on known quantities such as the dimensions of the biasing members, the distance the biasing members are deflected by the sidewalls 122, and material properties such as a modulus of elasticity and a coefficient of friction. For example, using Equations 1-3 below, the contact pressure caused by the biasing members 124 may be determined. Once the contact pressure is determined, the friction force applied to the shutter 112 may be determined using the coefficient of friction between the biasing members 124 and the sidewalls 122.

$$P = \frac{F}{A} = \frac{\left\{3\varepsilon\left(\frac{WT^3}{12}\right) * \delta\right\}}{L^3} \quad \text{Equation 1}$$

$$F = \frac{3\varepsilon I * \delta}{L^3} \quad \text{Equation 2}$$

$$I = \frac{WT^3}{12} \quad \text{Equation 3}$$

In Equations 1-3: P equals the contact pressure; F equals the bias force applied by the biasing member 124; A equals the contact area between the biasing member 124 and the sidewall 122; W, T and L equal the width, length and thickness of the biasing member 124 (see FIGS. 6A and 6C), respectively; ξ equals the modulus of elasticity of the material of the biasing member 124; and δ equals the deflection dimension (i.e., the distance the biasing member 124 is deflected by the sidewall 122 shown for example in FIG. 6C).

Since the bias force applied by the biasing members 124 by the sidewalls 122 can be predicted and is based in part on the dimensions of the biasing members 124, the bias force, and consequently the friction force, can be predicted and a desired friction force can be attained based on the physical design of the shutter 112. For example and without limitation, the friction force can be increased by increasing the deflection dimension δ (e.g., by increasing the angle between the biasing members 124 and the central end portions 126) or decreased by decreasing the deflection dimension δ (e.g., by decreasing the angle between the biasing members 124 and the central end portions 126). In accordance with the disclosed concept, a producer, such as a designer or manufacturer of the slider mechanism 106, can easily determine the friction force that provides a desired "feel" for the user (e.g., experimentally testing shutters 112 with slightly different deflection dimensions δ and selecting the shutter 112 that provides the most desirable "feel" for the user). Depending on the application of the slider mechanism 106, the desired amount of friction force between the shutter 112 and the sidewalls 122 may be different, so it is beneficial that only minor alterations in the physical design of the shutter 112 (e.g., changing the angle between the biasing members 124 and the central end portions 126) are needed to change the amount of friction force.

The slider assembly 106 also provides the benefit of providing a constant friction force through the entire range of motion of the slider mechanism 110. Because the slider mechanism 110 and shutter 112 slide in a direction parallel to the sidewalls 122, as is shown, for example, in FIG. 4, the angle of the biasing members 124 with respect to the sidewalls 122 does not change and, thus, the biasing member 124 provide a constant bias force against the sidewalls 122 as they slide along the sidewalls 122.

In addition to the slider assembly 106, the electrical switch 100 may also include other switching assemblies. For example, referring to FIG. 3, in some example embodiments of the disclosed concept, the electrical switch 100 further includes the rocker switch assembly 128. The rocker switch assembly 128 includes a switch 130 (e.g., without limitation, a rocker switch), bumpers 132 and a spring element 134. The rocker switch assembly 128 may work in conjunction with electrical components inside the electrical switch 100 to provide, for example, a switching function. That is, a user may toggle the switch 130 and, in response, the electrical switch 100 may control an electrical device to turn on or off. It will be appreciated, however, that any known or suitable alternative switching assembly may be employed instead of the rocker switch assembly 128 in the electrical switch 100. It will also be appreciated that, in some example embodiments of the disclosed concept, the rocker switch assembly 128, or alternative switching assemblies, may be omitted without departing from the scope of the disclosed concept.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A slider assembly for an electrical switch having an upper housing, the slider assembly comprising:

a slider mechanism structured to be disposed on an exterior surface of the upper housing; and a shutter structured to be disposed in an interior of said upper housing and to be coupled to said slider mechanism, said shutter including a number of biasing members structured to engage and apply a bias force against interior sidewalls of said upper housing, thereby creating a friction force associated with movement of said slider mechanism, wherein the shutter includes a first end portion disposed at a first end of said shutter and a second end portion disposed at a second end of said shutter opposite said first end, wherein the first end portion includes a first biasing member of said number of bias members and the second end portion includes a second biasing member of said number of biasing members, wherein the first biasing member is structured to apply a first bias force in a first direction against a first interior sidewall of said upper housing and the second biasing member is structured to apply a second bias force in a second direction against a second interior sidewall of said upper housing, wherein the first direction and the second direction are opposite with respect to each other, and wherein the shutter is a unitary piece.

2. The slider assembly of claim 1, wherein the upper housing includes a pair of channels; wherein the slider mechanism includes a first end having a first notch formed therein and a second end having a second notch formed therein, the first end of the slider mechanism being disposed opposite the second end of the slider mechanism; wherein the shutter includes a first end having a first protruding member formed thereon and a second end having a second protruding member formed thereon, the first end of the shutter being opposite the second end of the shutter; and wherein the first and second protruding members are structured to be inserted into the first and second notches via the pair of channels to couple the shutter to the slider mechanism.

3. The slider assembly of claim 1, wherein the first end portion and the second end portion each include a central end portion and two of said number of biasing members angled with respect to said central end portion and extending from opposite edges of said central end portion.

4. The slider assembly of claim 3, wherein at least one of the first end portion and the second end portion is a unitary piece.

5. The slider assembly of claim 4, wherein at least one of the first end portion and the second end portion is a molded member.

6. An electrical switch comprising:

an upper housing having an exterior surface and an interior including a number of interior sidewalls;

a slider mechanism disposed on the exterior surface of the upper housing; and a shutter disposed in the interior of said upper housing and coupled to said slider mechanism, said shutter including a number of biasing members structured to engage and apply a bias force against the interior sidewalls of said upper housing, thereby creating a friction force associated with movement of said slides mechanism, wherein the shutter includes a first end portion disposed at a first end of said shutter and a second end portion disposed at a second end of said shutter opposite said first end, wherein the first end portion includes a first biasing member of said number of biasing members and the second end portion includes a second biasing member of said number of biasing members, wherein the first biasing member is structured to apply a first bias force in a first direction against a first interior sidewall of said upper housing and the second biasing member is structured to apply a second bias force in a second direction against a second interior sidewall of said upper housing, wherein the first direction and the second direction are opposite with respect to each other, and wherein the shutter is a unitary piece.

7. The electrical switch of claim 6, further comprising:

a lower housing structured to couple to the upper housing, the lower housing and the upper housing cooperating to define an interior space of the electrical switch.

8. The electrical switch of claim 6, further comprising:

a switch assembly including a rocker switch, wherein the rocker switch is disposed in an opening formed in the upper housing.

9. The electrical switch of claim 6, wherein the upper housing includes a pair of channels; wherein the slider mechanism includes a first end having a first notch formed therein and a second end having a second notch formed therein, the first end of the slider mechanism being disposed opposite the second end of the slider mechanism; wherein the shutter includes a first end having a first protruding member formed thereon and a second end having a second protruding member formed thereon, the first end of the shutter being opposite the second end of the shutter; and wherein the first and second protruding members extend into the first and second notches via the pair of channels to couple the shutter to the slider mechanism.

10. The electrical switch of claim 9, wherein the upper housing includes a slide surface having a substantially rectangular shape; wherein the pair of channels are disposed along opposite sides of the slide surface; and wherein the slider mechanism is disposed of the slide surface and is structured to slide along the slide surface.

11. The electrical switch of claim 6, wherein the first end portion and the second end portion each include a central end portion and two of said number of biasing members angled with respect to said central end portion and extending from opposite edges of said central end portion.

12. The electrical switch of claim 11, wherein when the shutter is installed in the electrical switch, said number of biasing members are structured to be depressed by the interior sidewalls to reduce an amount said number of biasing members are angled with respect to said central end portions.

13. The electrical switch of claim 11, wherein at least one of the first end portion and the second end portion is a unitary piece.

14. The electrical switch of claim 13, wherein at least one of the first end portion and the second end portion is a molded member.

* * * * *